US005654086A

United States Patent [19]

Nishijima et al.

[11] Patent Number: 5,654,086

[45] Date of Patent: Aug. 5, 1997

[54] DURABLE HYDROPHILIC FIBERS, CLOTH ARTICLES AND MOLDED ARTICLES

[75] Inventors: Masaru Nishijima; Masayasu Suzuki, both of Shigaken, Japan

[73] Assignee: Chisso Corporation, Osaka, Japan

[21] Appl. No.: 683,631

[22] Filed: Jul. 15, 1996

[30] Foreign Application Priority Data

Aug. 1, 1995 [JP] Japan ..... 7-216794

[51] Int. Cl.[6] ..... D03D 3/00

[52] U.S. Cl. ..... 442/199; 428/365; 428/373; 428/374; 428/375; 428/395; 442/200; 442/201; 442/301; 442/361; 442/362; 442/363; 442/364; 442/414

[58] Field of Search ..... 428/229, 253, 428/365, 373, 374, 375, 395

[56] References Cited

U.S. PATENT DOCUMENTS

| | | | |
|---|---|---|---|
| 5,532,052 | 7/1996 | Eng et al. | 428/229 |
| 5,540,965 | 7/1996 | Nishimura et al. | 428/229 |

FOREIGN PATENT DOCUMENTS

| | | |
|---|---|---|
| 63-6166 | 1/1988 | Japan . |
| 63-49158 | 3/1988 | Japan . |
| 1-148879 | 6/1989 | Japan . |
| 1-148880 | 6/1989 | Japan . |
| 63-303184 | 12/1989 | Japan . |
| 2-169774 | 6/1990 | Japan . |
| 3-59169 | 3/1991 | Japan . |
| 3-50030 | 7/1991 | Japan . |

*Primary Examiner*—Morton Foelak

*Attorney, Agent, or Firm*—Lowe, Price, LeBlanc & Becker

[57] ABSTRACT

Improvement in a hydrophilic function and in the strength of a cloth article obtained from a durable hydrophilic fibers is attained by the employment a durable hydrophilic fiber consisting of a fiber made of a thermoplastic resin to which 0.2 to 1.0% by weight of a mixture formed of the following surfactant (A),(B), (C), (D) and (E) is adhered:

(A) 10 to 30% by weight of one or more compounds selected out of polyoxyalkylene additive of higher alcohol or higher alkylamine of carbon number 28 to 50, or amide formed of fatty acid of carbon number 30 to 50 and polyamine, (B) 10 to 30% by weight of a polyoxyalkylene additive of amide formed of fatty acid of carbon number 20 to 28 and polyamine, (C) 30 to 50% by weight of an amide formed of higher fatty acid of carbon number 16 to 28, and alkanolamine, (D) 10 to 30% by weight of polyoxyalkylene additive of alkylphosphate salt of carbon number 10 to 22, and (E) 2 to 10% by weight of alkylsulfonate salt of carbon number 12 to 16.

8 Claims, No Drawings

DURABLE HYDROPHILIC FIBERS, CLOTH ARTICLES AND MOLDED ARTICLES

BACKGROUND OF THE INVENTION

1. Field of the Invention

The present invention relates to durable hydrophilic fibers, and more specifically, to durable hydrophilic fibers, and cloth articles and molded articles obtained by using the fibers which are useful for surface materials for paper diapers, sanitary napkins, etc. mainly in the field of hygienic materials, useful for form retaining goods and molding retaining goods of moisture absorbent articles, and useful for industrial and medical wiping clothes.

2. Description of the Prior Art

A paper diaper or the like is formed with three layers, i.e., a surface material, an absorbent material and a back material from the side with which the skin touches when worn. The surface material need to have a water permeability by which a liquid to be absorbed is rapidly transmitted to the absorbent material, and a dry touch property by which the absorbed liquid is prevented from back flowing to impart the skin dry feeling. Hydrophilic property is preferred in order to improve the water permeability, and hydrophobic property is preferred in order to improve the dry touch property. For achieving the aforesaid object, nonwoven fabrics are used in which a small amount of surfactant is adhered to fibers formed of a polyolefin resin or a polyester resin (Japanese Patent Application Laid-Open No. 63-6166 Publication and Japanese Patent Application Laid-Open No. 63-49158 Publication).

In the surface material using the fibers to which the surfactant is adhered as described above, when liquids are absorbed once or twice therefrom, the surfactant flows out and the water permeability rapidly lowers so that the liquids remain on the surface material, resulting in imparting unpleasantness. As the material which reduces the flow-out of the surfactant adhered to the fibers and in which even if water is permeated repetitively, the hydrophilic property is not lowered, nonwoven fabrics formed of durable hydrophilic fibers to which is adhered a surfactant containing a water soluble modified silicone have been known (Japanese Patent Application Laid-Open Nos. 63-303814, 1-148879, 1-148880, 2-169774 and 3-59169 Publications).

However, these nonwoven fabrics or woven fabrics formed of the durable hydrophilic fibers to which the surfactant is adhered were good in the durable hydrophilic property but were suffered from a problem in that since the water soluble modified silicone is contained as an essential composition, the friction of fibers reduces, the fibers constituting a fiber laminate such as nonwoven fabrics slips, and the strength of web lowers and the strength of a fiber laminate such as nonwoven fabrics lowers. There was a further problem in that also in the wrapping process of the goods of the obtained cloth articles, since the smoothness between the cloth articles is so high that the wrapping form of the goods is not stable.

In Japanese Patent Application Laid-Open No. 3-50030 Publication, there is proposed a method for imparting hydrophilic property for adhering a mixture of alkyrol amide and an alkylene oxide additive of a compound having an active hydrogen or a surfactant such as alkylphosphate to polyolefin fibers. However, in this method, the durable hydrophilic property is not sufficient, and the electric resistance is not good.

It is therefore an object of the present invention to provide durable hydrophilic fibers, and cloth articles and molded articles using said fibers, which have the durable hydrophilic property raised by the prior art as described above, which reduces the slip of fibers not to lower the strength of a fiber laminate such as nonwoven fabrics.

SUMMARY OF THE INVENTION

The present inventors have studied zealously in an attempt of solving the above-described problems, and as a result, obtained a prospect capable of overcoming the above-described problems by adhering a mixture of a special surfactant composition as a finishing agent to the surface of fibers, thus completing the present invention.

The present invention has the following constitutions:

(1) A durable hydrophilic fiber consisting of a fiber made of a thermoplastic resin to which 0.2 to 1.0% by weight of a mixture formed of the following surfactant (A),(B), (C), (D) and (E) is adhered:

(A) 10 to 30% by weight of one or more compounds selected out of polyoxyalkylene additive of higher alcohol or higher alkylamine of carbon number 28 to 50, or amide formed of fatty acid of carbon number 30 to 50 and polyamine, (B) 10 to 30% by weight of a polyoxyalkylene additive of amide formed of fatty acid of carbon number 20 to 28 and polyamine, (C) 30 to 50% by weight of an amide formed of higher fatty acid of carbon number 16 to 28, and alkanolamine, (D) 10 to 30% by weight of polyoxyalkylene additive of alkylphosphate salt of carbon number 10 to 22, and (E) 2 to 10% by weight of alkylsulfonate salt of carbon number 12 to 16.

(2) A durable hydrophilic fiber according to claim 1, wherein the fiber is a composite fiber in which at least two components of thermoplastic resin are arranged in side-by-side type or in sheath-and-core type.

(3) A durable hydrophilic fiber according to claim 1, wherein the fiber is a composite fiber in which at least two components of thermoplastic resin are arranged in radial split type or in sea and island type.

(4) A durable hydrophilic fiber according to any of above (1) to (3), wherein at least one component of thermoplastic resin constituting the fiber is a polyolefin resin.

(5) A durable hydrophilic fiber according to any of above (1) to (3), wherein at least one component of thermoplastic resin constituting the fiber is a polyester resin.

(6) A cloth article obtained by confounding and/or adhering the durable hydrophilic fiber according to any of above (1) to (5).

(7) A cloth article obtained by knitting or weaving the durable hydrophilic fiber according to any of above (1) to (5).

(8) A molded article obtained by the durable hydrophilic fiber according to any of above (1) to (5) alone or in mixture.

DETAILED DESCRIPTION OF THE INVENTION

The present invention will now be described in detail.

As thermoplastic fibers used in the present invention, there can be exemplified a combination of polyolefin-base, polyester-base and polyamide-base thermoplastic resins.

In the case where these materials are used as a surface material particularly in the field of hygienic materials, preferred are the polyolefin-base, and polyester-base thermoplastic resins.

The polyolefin-base resin is a homopolymer of ethylene or propylene, or a crystalline copolymer ethylene or propylene with other α-olefins, or a mixture thereof. The α-olefin copolymer includes an olefin-base copolymer or terpolymer mainly comprising propylene. Examples of these copolymers include copolymers such as ethylene or butene-1 or 4-methylpentene-1 mainly comprising propylene. As polyester-base resins, there can be exemplified polyethylene terephthalate, polybutylene terephthalate, poly(ethylene terephthalate-co-ethylene isophthalate) or polyether ester.

A mixture of a polyester-base resin or a polyamide-base resin and a polyolefin-base resin can be suitably selected depending on uses.

In these thermoplastic fibers, an additive having other functions can be combined into the fibers within the range for achieving the object of the present invention, these capable of being selected while adjusting to uses and suitably combined.

A mixture (hereinafter referred to as a finishing agent) comprising (A), (B), (C), (D) and (E) of a surfactant composition used in the present invention will be described below.

(A): One or more compounds selected out of polyoxyalkylene additive of higher alcohol or higher alkylamine of carbon number 28–50, or fatty acid amide formed of fatty acid of carbon number 30–50 and polyamine.

The polyoxyalkylene additive of higher alcohol or higher alkylamine is an alkyleneoxide additive of saturated or unsaturated alcohol or amine that may have a side chain of carbon number 28–50. If the carbon number is less than 28, it is difficult to obtain a sufficient durable hydrophilic nature. The polyoxyalkylene additive of fatty acid amide is likewise an alkylene oxide additive of saturated or unsaturated fatty acid that may have a side chain of carbon number 30–50 and polyamines, for example, such as ethylenediamine, diethylenetriamine, triethylenetetramine, etc. or diethylethylenediamine, aminoethylethanolamine, etc. If the carbon number is less than 30, it is difficult to obtain a sufficient durable hydrophilic property. If the carbon number exceeds 50, cost increases, being not suitable for practical use.

A polyoxyalkylene group comprises a random or block copolymer of alkylene oxide such as ethylene oxide, propylene oxide, butylene oxide, etc., particularly, ethylene oxide alone or ethylene oxide and propylene oxide, and the additive mol number is 2–20 mol, more preferably, 5–15 mol. Propylene oxide copolymerized is eqivalent mol to that of ethylene oxide, or preferably less than that.

The compounding amount of (A) is 10–30% by weight, more preferably, 15–25% by weight. If less than 10% by weight, a sufficient durable hydrophilic property is not obtained. If exceeding 40% by weight, a solution viscosity becomes so high that a solubility becomes poor.

(B): A polyoxyalkylene additive of fatty acid amide of carbon number 20–28.

The polyoxyalkylene additive of higher fatty acid amide is fatty acid monoamide or fatty acid diamide obtained in a conventional reaction between saturated or unsaturated fatty acid that may have a side chain of carbon number 20 to 28, for example, such as aragin acid, behenic acid, lignoceric acid, montanic acid, etc., and polyethylene polyamines, for example, such as ethylene diamine, diethylene triamine, triethylene tetramine, etc., or diethylethylenediamine, aminoethylethanoleamine, etc. If the carbon number less than 20, the durable hydrophilic property is poor, and if exceeding 28, the initial hydrophilic property is poor.

A polyoxyalkylene group is preferably an additive of 5–30 mol of alkylene oxide, particularly ethylene oxide such as ethylene oxide, propylene oxide, butylene oxide, etc. If the mol number of ethylene oxide is less than 5, the solubility lowers, and if exceeding 30 mol, the liquid transmittance of the cloth article becomes slow.

The compounding amount of (B) is 10–30% by weight, more preferably, 15–30% by weight. If less than 10% by weight, a durable hydrophilic property as intended is not obtained. If exceeding 30% by weight, a water absorbing speed of the cloth article becomes slow.

Surfactant (C): An amide comprising higher fatty acid of carbon number 16–28 and alkanolamine. That is, this is obtained in a conventional reaction between saturated or unsaturated fatty acid that may have a side chain of carbon number 16–28 and alkanolamine, for example, such as monoethanolamine, diethanolamine, monoisopropanolamine, etc. Particularly suitable alkanolamide is a reaction mixture in 2:1 to 1:2 (equivalent ratio) between higher fatty acids such as stearic acid, oleic acid, behenic acid, erucic acid, etc. and diethanolamine. If the carbon number is less than 16, a sufficient durable hydrophilic property is not obtained, and if exceeding 28, cost increases, which not suitable for practical use.

The compounding amount of (C) is 30–50% by weight, more preferably, 30–45% by weight. If less than 30% by weight, a durable hydrophilic property lowers. If exceeding 50% by weight, the cylinder wrapping results in the carding process or the like, lowering the evenness.

With respect to the above-described three surfactants (A), (B) and (C), HLB(hydrophile-lipophile balance)2–19, preferably 5–15 are generally suitable, but it depends on the hydrophilic property of an anion surfactant to be mixed.

(D): A polyoxylalkylene additive of alkylphosphate salt of carbon number 10–22. In the polyoxylalkylene alkylphosphate salt, an alkyl group is preferably a saturated or unsaturated complete neutral salt that may have a side chain of mono or diphosphate of such as decyl alcohol, laurel alcohol, myristyl alcohol, etc. of carbon number 10–22, more preferably 10–14. A polyoxyalkylene group is alkylene oxide such as ethylene oxide, propylene oxide, butylene oxide, etc. particularly, ethylene oxide alone or a random or block copolymer of ethylene oxide and propylene oxide. The mol number added is, in case of ethylene oxide alone, 2–10 mol, more preferably, 3–7 mol.

The neutral salts include alkaline metal such as K, Na, etc., ammonia and amine but are preferably K salt or Na salt in terms of electric resistance. If the carbon number of alcohol is less than 10, the friction between fibers and metal increases to lower the card transmittance, resulting in the cylinder wrapping. Further, if exceeding 22, the electric resistance lowers.

The compounding amount of (D) is 10–30% by weight. If less than 10% by weight, the electric resistance is not sufficient, and if exceeding 30% by weight, a durable hydrophilic property lowers.

The surfactant (E) is alkylsulfonate salt of carbon number 12–16. The alkylsulfonate salt (E) particularly can obtain an excellent electric resistance and examples thereof include petroleum sulfonic acid Na salt, and alkylbenzenesulfonic acid Na salt. The petroleum sulfonic acid Na salt of carbon number 12–16 is preferred in terms of affinity with the fibers.

The adequate using amount of (E) is 2–10% by weight, more preferably 5–10% by weight. If exceeding 10% by weight, the cylinder wrapping and the sticking to the cloth article result in the carding process.

It is preferred in the finishing agent adhered to the durable hydrophilic fibers according to the present invention that the surfactants (A), (B), (C), (D) and (E) are mixed in the above-described adequate using range, at least 85% or more of the whole additives. It is to be noted that conventional surfactants other than the above-described 5 surfactants can be added within the range not impeding the object of the present invention according to the thermoplastic resins constituting the fibers, cloth articles and molded articles.

The adhesion amount of the finishing agent to the above-described thermoplastic fibers is 0.2–1.0, more preferably 0.3–0.7.

If the adhesion amount is less than 0.2% by weight, the electric resistance and the durable hydrophilic property are insufficient, and if exceeding 1.0% by weight, the cylinder wrapping and the sticking to the cloth article result in the carding process.

The method for adhering these finishing agents to the thermoplastic fibers has no particular limitation but well known methods such as adhesion by contact with an oiling roll, immersion into an immersion tank and spraying in spinning or drawing process, or adhesion by a contact method, an immersion method and a spraying method after being processed to a fiber laminate such as a web, a cloth article such as nonwoven fabrics or a molded article can be used.

The durable hydrophilic fibers according to the present invention is obtained by adhering the finishing agent to the thermoplastic fibers, and sectional structures thereof may be a single structure or a composite structure. Also, a section shape may be circular, irregular, hollow or the like. The fiber form may be short fibers, long fibers, or crimped or not crimped fiber according to uses, or a combination thereof.

In connection with the function of the finishing agent, the behavior during the high pressure water flow process in a split type composite fiber as one example will be described below.

Normally, for example, in a radial split type composite fiber formed of a hydrophobic thermoplastic resin, a normal hydrophilic surfactant adhered to the surface of fiber as a fiber finishing agent is washed away rapidly in the process of forming into nonwoven fabrics by way of high pressure water flow. Since these fibers are extremely strong hydrophobic in fiber itself, the fiber avoids a water flow in the initial stage of the process of forming into nonwoven fabrics by way of high pressure water flow, failing to evenly receive shock energy of water. For this reason, sufficiently evenly divided extremely fine fiber nonwoven fabrics are not obtained unless increase of the number of stage of high pressure water flows.

On the other hand, in the radial split type composite fiber adhered to the finishing agent according to the present invention, the fiber itself is formed of an extremely strong hydrophobic thermoplastic resin similarly to the conventional case. However, since the finishing agent of the present invention adhered to the surface of fiber is very gently discrete, the hydrophilic property can be sufficiently maintained. Even if the process for nonwoven fabrics by way of high pressure water flow is repeated, the fiber evenly receives the shock energy of water without avoiding the water flow, and sufficiently evenly divided extremely fine fiber nonwoven fabrics can be obtained in less number of stages.

Further, in the durable hydrophilic fibers of the present invention, since the finishing agent is very gently discrete in water in the wet process such as paper making even in case of fibers using a hydrophobic resin such as a polyolefin-base resin, the hydrophilic property of the fiber is maintained and in-water dispersion retaining properties are excellent.

The cloth article using the durable hydrophilic fibers of the present invention are produced by conventional methods. For example, there is a method for obtaining nonwoven fabrics which comprises forming short fibers into a fiber laminate by a dry method or a wet method, pressing by a heating roll or supersonic wave, fusion by heating air, fiber confounding by high pressure water flow or needles. A further method comprises using spun yarns, continuous yarns or the like to obtain woven cloth by knitting and weaving processes.

Further, the object of the present invention can be attained by adhering the finishing agent to the once obtained cloth article, for example, the cloth article according to the above-described method or the cloth article obtained by a spun bond method, a melt blown method, a flush spinning method or the like. Further, it is possible to impart an absorbent shape retaining properties by cutting, out of the durable hydrophilic fiber according to the present invention, the composite fiber arranged in side-by-side type, sheath-and-core type, radial divided type and sea and island type and mixing it with a water absorbent material such as pulp and a high molecule absorbent resin and applying heat treatment thereto. In general, the thermoplastic composite fiber causes the water absorbing performance of the absorbent to low decreasing with the ratio of blended cotton. However, since the durable hydrophilic fiber of the present invention maintains the hydrophilic property, the water absorbing performance rarely lowers.

The durable hydrophilic fibers, cloth articles and molded article according to the present invention can be used in the wide field of the form retaining materials for the surface material and absorbent in the field of hygienic materials constructed as described above, the medical and industrial wiping clothes, the absorbing pad, and fibers for reinforcing architectural structures, liquid transport films, drainage, water permeable sheets, etc. in the field of civil engineering and structure.

EXAMPLES

The present invention will be described in detail hereinafter but is not limited to the following Examples and Comparative Examples as far as they are not beyond the gist of the present invention.

In the Examples, the following properties evaluation methods were used.

(1) Electric resistance: 40 g of sample fibers were formed into webs using a card testing machine at a speed of 7 m/min under the conditions of temperature of 20° C. and relative humidity of 45%. A voltage of static electricity generated in the web was measured for evaluation in the following references. If the voltage is less than 100 V, judgement was made to be practically usable.

○: less than 100 V

Δ: 100 V or more but less than 500 V x: 500 V or more (2) Card passage: 40 g of material fibers were formed into webs using a miniature card testing machine at a speed of 7 m/min under the conditions of temperature of 30° C. and relative humidity of 80%. After this, a card testing machine is stopped, and a cylinder was observed for evaluation in the following references.

○: no wrapping

Δ: partial wrapping x: almost totally wrapping (3) State of web: The state of web prepared by the above-described method for evaluation in the following references.

○: no nep, has tension and even

Δ: partial nep x: no tension in web, uneven xx: waste cotton, or rupture of web (4) Hydrophilic property of fiber: 5 g of sample fibers prepared by a card machine or the like were packed into a cage made of copper wires having a diameter of 3 cm, length of 8 cm and weight of 3 g. The cage was quietly floated on the water level of a water vessel at a water temperature of 25° C., and the time till the sample together with the cage sinks into water was measured. The precipitated sample was immediately pulled out of water and centrifugally dewatered and dried in air for 24 hours at a room temperature. The precipitating time was measured in the same procedure. This measurement was repeated three times. Judgement was made such that if the precipitating time is less than 10 seconds, the hydrophilic property was good, and if the measured value for the third time was also less than 10 seconds, the durable hydrophilic property was also good.

(5) Durable hydrophilic property of cloth article: 30 g/m2 (weight per unit area) of cloth article was cut into 10 cm×10 cm, which was placed on a commercially available paper diaper on which is placed a cylinder having an inner diameter of 6 cm. 65 ml of water was poured into the cylinder to allow the cloth article to pass therethrough to absorb it in the paper diaper. After left for 3 minutes after pouring water, the cloth article was put between two upper and lower filter sheets (Toyo Roshi, No. 50), on which a plate (10 cm ×10 cm) and a weight of weight 3.5 kg were placed. They were left for 3 minutes and dewatered, after which dried in air for 5 minutes. The obtained cloth article was placed on a filter sheet (Toyo Rosi, No. 50). Water prepared to 23°±2° C. in an isothermic water vessel was dropped (20 droplets in total) droplet by droplet by a pipette from a height 1 cm from the cloth article while displacing a position. The number of water droplets disappearing from the surface of the cloth article in 10 seconds or less was measured. The measured cloth article was placed on a commercially available paper diaper. The similar operation was repeated three times.

(6) Tactile feeling: The tactile feeling of a sample cloth article was determined in a functional test by ten examiners for evaluation in the following references.

○: 8 or more persons judged to be free from sticking and good

Δ: 6 or less persons judged to feel sticking or to feel a sense of incongruity.

x: 3 or more persons judged to feel sticking.

EXAMPLES 1 to 12 and COMPARATIVE EXAMPLES 1 to 12

A thermoplastic resin of component A: polypropylene, component B: polyester, and component C: high density polyethylene was used to provide a fiber having one of sections (a single structure (a single type), a sheath-and-core type structure, a side-by-side type structure, a radial 16-split type structure (split type) and a sea and island arranged structure (sea and island type). A finishing agent of various compositions given in Tables 1, 2, 3 and 4 was adhered, and the obtained fiber was formed into a cloth article in the following processes:

Process a: The fiber was formed into a card web by a miniature card machine, and heat treated by a suction dryer (140° C.) to obtain nonwoven fabrics of about 30 g/m2.

Process b: The fiber was formed into a card web by a miniature card machine, and heat treated by an emboss roll (130° C., line pressure 20 kg/cm) to obtain nonwoven fabrics of about 30 g/m2.

Process c: The fiber was subjected to spinning process to obtain spin yarns of count 40. This spin yarns were knitted by a circular knitting machine to obtain a knitted cloth.

See Tables 1, 2, 3 and 4.

The durable hydrophilic fibers, cloth articles and molded articles according to the present invention are excellent in durable hydrophilic property and free from sticky feeling. Therefore, in the case where the above fibers are used, for example, as a surface material of a paper diaper or a sanitary napkin in the field of hygienic materials, even after use for long time, the absorbing performance with respect to body fluids is not lowered, and the products agreeable to the touch are obtained.

TABLE 1

| | | Ex 1 | Ex 2 | Ex 3 | Ex 4 | Ex 5 | Ex 6 |
|---|---|---|---|---|---|---|---|
| Compositions of the invention | | | | | | | |
| A | (C30)alkylether PO(5)EO(5) | 20 | | | | 28 | 20 |
| | (C30)alkylether EO(10) | | 20 | | | | |
| | (C30)alkylamine EO(10) | | | 20 | | | |
| | Melissic acid amide EO(10)*1 | | | | 20 | | |
| B | Behenic acid amide EO(10)*2 | 25 | 25 | 25 | 25 | 25 | 10 |
| C | Stearic acid diethanol amide*3 | 35 | 35 | 35 | 35 | 30 | 50 |
| D | EO(5)laurel phosphate K salt | 15 | 15 | 15 | 15 | 15 | 15 |
| E | (C14–C16)alkylsulfonate Na salt | 5 | 5 | 5 | 5 | 2 | 5 |
| Other compositions | | | | | | | |
| | (C26)alkylether EO(10) | | | | | | |
| | Stearic acid amide EO(10)*3 | | | | | | |
| | Myristic acid diethanolamide | | | | | | |
| | (C8)alkylphosphate K salt EO(5) | | | | | | |
| | (C24)alkylphosphate K salt EO(5) | | | | | | |
| | Polyether modified silicon (EO modified) | | | | | | |
| | Sorbitan monolate | | | | | | |
| | Laurel phosphate K salt | | | | | | |
| | Adhesion amount (%) | 0.5 | 0.5 | 0.5 | 0.5 | 0.4 | 0.5 |
| Fibers | | | | | | | |
| Resins | Fiber structure | * | * | * | * | * | ** |
| | First component | A | A | A | A | B | A |
| | Second component | C | C | C | C | C | |
| Card | Electric resistance | o | o | o | o | o | o |
| passage | Card passage | o | o | o | o | o | o |

TABLE 1-continued

| | | | | | | | |
|---|---|---|---|---|---|---|---|
| | State of web | o | o | o | o | o | o |
| Hydrophilic | First | 5.5 | 5.1 | 5.2 | 5.5 | 6.2 | 4.8 |
| property(SEC) | Second | 6.8 | 5.8 | 7.0 | 6.8 | 7.2 | 5.4 |
| | Third | 7.2 | 6.6 | 7.5 | 7.5 | 7.9 | 6.5 |
| Cloth article | Form of cloth article | | | | | | |
| | (Process method) | a | a | a | a | a | b |
| Durable Hydro- | First | 20 | 20 | 20 | 20 | 20 | 20 |
| philic property | Second | 17 | 18 | 20 | 17 | 19 | 20 |
| ( /20) | Third | 15 | 16 | 16 | 15 | 16 | 17 |
| Feeling | | o | o | o | o | o | o |

*1 C29H59—CONH—C2H4—NH(EO)10—C2H4—NHCO—C29H59 EO: ethylene oxide
*2 C21H43—CONH—C2H4—NH(EO)10—C2H4—NHCO—C21H43 PO: propylene oxide
*3 C17H35—CONH—C2H4—NH(EO)10—C2H4—NHCO—C17H35
*Sheath-and-core
**Single

TABLE 2

| | | Ex 7 | Ex 8 | Ex 9 | Ex 10 | Ex 11 | Ex 12 |
|---|---|---|---|---|---|---|---|
| Compositions of the invention | | | | | | | |
| A | (C30)alkylether PO(5)EO(5) | 10 | 20 | 15 | 20 | 20 | 20 |
| | (C30)alkylether EO(10) | | | | | | |
| | (C30)alkylamine EO(10) | | | | | | |
| | Melissic acid amide EO(10) | | | | | | |
| B | Behenic acid amide EO(10) | 30 | 20 | 10 | 25 | 20 | 20 |
| C | Stearic acid diethanol amide | 40 | 40 | 40 | 35 | 35 | 40 |
| D | EO(5)laurel phosphate K salt | 15 | 10 | 30 | 12 | 10 | 10 |
| E | (C14–C16)alkylsulfonate Na salt | 5 | 10 | 5 | 5 | 5 | 5 |
| Other compositions | | | | | | | |
| | (C26)alkylether EO(10) | | | | | | |
| | Stearic acid amide EO(10)*3 | | | | | | |
| | Myristic acid diethanolamide | | | | | | |
| | (C8)alkylphosphate K salt EO(5) | | | | | | |
| | (C24)alkylphosphate K salt EO(5) | | | | | | |
| | Polyether modified silicon (EO modified) | | | | 3 | | |
| | Sorbitan monolate | | | | | 10 | |
| | Laurel phosphate K salt | | | | | | 5 |
| | Adhesion amount (%) | 0.5 | 0.5 | 0.5 | 0.3 | 0.5 | 0.5 |
| Fibers | | | | | | | |
| Resins | Fiber structure | * | *4 | *5 | ** | * | *6 |
| | First component | A | A | A | A | A | A |
| | Second component | C | C | C | | C | C |
| Card | Electric resistance | o | o | o | o | o | 0 |
| passage | Card passage | o | o | o | o | o | o |
| | State of web | o | o | o | o | o | o |
| Hydrophilic | First | 5.0 | 4.7 | 4.5 | 5.2 | 4.8 | 4.1 |
| property(SEC) | Second | 6.2 | 6.4 | 7.2 | 6.3 | 6.6 | 6.8 |
| | Third | 6.9 | 6.6 | 8.0 | 7.2 | 7.4 | 8.2 |
| Cloth article | Form of cloth article | | | | | | |
| | (Process method) | a | a | a | c | a | a |
| Durable Hydro- | First | 20 | 18 | 20 | 20 | 19 | 20 |
| philic property | Second | 18 | 16 | 17 | 19 | 18 | 17 |
| ( /20) | Third | 16 | 15 | 15 | 17 | 16 | 15 |
| Feeling | | o | o | o | o | o | o |

*Sheath-and-core
*4 split
*5 side-by-side
**single
*6 sea and island

TABLE 3

| | | C.Ex 1 | C.Ex 2 | C.Ex 3 | C.Ex 4 | C.Ex 5 | C.Ex 6 |
|---|---|---|---|---|---|---|---|
| Compositions of the invention | | | | | | | |
| A | (C30)alkylether PO(5)EO(5) | 5 | 20 | 20 | 45 | 10 | 20 |
| | (C30)alkylether EO(10) | | | | | | |
| | (C30)alkylamine EO(10) | | | | | | |
| | Melissic acid amide EO(10) | | | | | | |

TABLE 3-continued

| | | | | | | | |
|---|---|---|---|---|---|---|---|
| B | Behenic acid amide EO(10) | 30 | 25 | 25 | | 10 | 25 |
| C | Stearic acid diethanol amide | 35 | 35 | 35 | 40 | 10 | 40 |
| D | EO(5)laurel phosphate K salt | 20 | 15 | 15 | 10 | 10 | 15 |
| E | (C14–C16)alkylsulfonate Na salt | 10 | 5 | 5 | 5 | 10 | |
| Other compositions | | | | | | | |
| | (C26)alkylether EO(10) | | | | | | |
| | Stearic acid amide EO(10) | | | | | | |
| | Myristic acid diethanolamide | | | | | | |
| | (C8)alkylphosphate K salt EO(5) | | | | | | |
| | (C24)alkylphosphate K salt EO(5) | | | | | | |
| | Polyether modified silicon (EO modified) | | | | | 50 | |
| | Sorbitan monolate | | | | | | |
| | Laurel phosphate K salt | | | | | | |
| | Adhesion amount (%) | 0.4 | 1.5 | 0.1 | 0.5 | 0.5 | 0.5 |
| Fibers | | | | | | | |
| Resins | Fiber structure | * | * | * | *5 | * | * |
| | First component | A | A | A | A | A | A |
| | Second component | C | C | C | C | C | C |
| Card | Electric resistance | o | o | x | Δ | o | x |
| passage | Card passage | o | x | x | x | o | Δ |
| | State of web | o | Δ | xx | Δ | x | x |
| Hydrophilic | First | 4.9 | 4.9 | 17.3 | 7.8 | 5.2 | 5.4 |
| property(SEC) | Second | 11.3 | 5.5 | — | 9.7 | 6.3 | 5.7 |
| | Third | — | 6.2 | — | 18.2 | 7.0 | 6.1 |
| Cloth article | Form of cloth article | | | | | | |
| | (Process method) | a | a | — | a | a | — |
| Durable Hydro- | First | 5 | 20 | — | 15 | 18 | — |
| philic property | Second | — | 20 | — | 15 | 17 | — |
| ( /20) | Third | — | 20 | — | 12 | 15 | — |
| Feeling | | o | x | — | x | o | — |

TABLE 4

| | | C.Ex 7 | C.Ex 8 | C.Ex 9 | C.Ex 10 | C.Ex 11 | C.Ex 12 |
|---|---|---|---|---|---|---|---|
| Compositions of the invention | | | | | | | |
| A | (C30)alkylether PO(5)EO(5) | | | | | 20 | |
| | (C30)alkylether EO(10) | | 20 | | | | |
| | (C30)alkylamine EO(10) | | | 20 | | | |
| | Melissic acid amide EO(10) | | | | 20 | | |
| B | Behenic acid amide EO(10) | 25 | | 25 | 25 | 25 | 20 |
| C | Stearic acid diethanol amide | 35 | 35 | | 35 | 35 | 35 |
| D | EO(5)laurel phosphate K salt | 15 | 15 | 15 | | | |
| E | (C14–C16)alkylsulfonate Na salt | 5 | 5 | 5 | 5 | 5 | |
| Other compositions | | | | | | | |
| | (C26)alkylether EO(10) | 20 | | | | | |
| | Stearic acid amide EO(10) | | 25 | | | | 25 |
| | Myristic acid diethanolamide | | | 35 | | | |
| | (C8)alkylphosphate K salt EO(5) | | | | 15 | | |
| | (C24)alkylphosphate K salt EO(5) | | | | | 15 | 15 |
| | Polyether modified silicon (EO modified) | | | | | | |
| | Sorbitan monolate | | | | | | |
| | Laurel phosphate K salt | | | | | | |
| | Adhesion amount (%) | 0.5 | 0.5 | 0.5 | 0.5 | 0.5 | 0.5 |
| Fibers | | | | | | | |
| Resins | Fiber structure | * | * | * | * | * | * |
| | First component | A | A | A | A | A | A |
| | Second component | C | C | C | C | C | C |
| Card | Electric resistance | o | o | o | o | x | o |
| passage | Card passage | o | o | o | x | Δ | o |
| | State of web | o | o | o | x | x | o |
| Hydrophilic | First | 4.8 | 5.1 | 4.2 | 4.0 | 8.2 | 4.0 |
| property(SEC) | Second | 8.8 | 8.3 | 12.0 | 16.8 | 12.2 | 17.2 |
| | Third | 30.2 | 26.6 | 27.5 | 47.5 | 20.9 | 57.9 |
| Cloth article | Form of cloth article | | | | | | |
| | (Process method) | a | a | a | a | a | a |
| Durable Hydro- | First | 13 | 15 | 12 | 8 | — | 7 |
| philic property | Second | — | 10 | — | — | — | — |
| ( /20) | Third | — | — | — | — | — | — |
| Feeling | | Δ | o | Δ | Δ | — | o |

What is claimed is:

1. A durable hydrophilic fiber consisting of a fiber made of a thermoplastic resin to which 0.2 to 1.0% by weight of a mixture formed of the following surfactant (A),(B), (C), (D) and (E) is adhered:

(A) 10 to 30% by weight of one or more compounds selected out of polyoxyalkylene additive of higher alcohol or higher alkylamine of carbon number 28 to 50, or amide formed of fatty acid of carbon number 30 to 50 and polyamine, (B) 10 to 30% by weight of a polyoxyalkylene additive of amide formed of fatty acid of carbon number 20 to 28 and polyamine, (C) 30 to 50% by weight of an amide formed of higher fatty acid of carbon number 16 to 28, and alkanolamine, (D) 10 to 30% by weight of polyoxyalkylene additive of alkylphosphate salt of carbon number 10 to 22, and (E) 2 to 10% by weight of alkylsulfonate salt of carbon number 12 to 16.

2. A durable hydrophilic fiber according to claim 1, wherein the fiber is a composite fiber in which at least two components of thermoplastic resin are arranged in side-by-side type or in sheath-and-core type.

3.A durable hydrophilic fiber according to claim 1, wherein the fiber is a composite fiber in which at least two components of thermoplastic resin are arranged in radial split type or in sea and island type.

4. A durable hydrophilic fiber according to claim 1, wherein at least one component of thermoplastic resin constituting the fiber is a polyolefin resin.

5. A durable hydrophilic fiber according to claim 1, wherein at least one component of thermoplastic resin constituting the fiber is a polyester resin.

6. A cloth article obtained by confounding and/or adhering the durable hydrophilic fiber according to claim 1.

7. A cloth article obtained by knitting or weaving the durable hydrophilic fiber according to claim 1.

8. A molded article obtained by the durable hydrophilic fiber according to claim 1.

* * * * *